United States Patent [19]

Lucksinger

[11] 4,167,279

[45] Sep. 11, 1979

[54] VERTICALLY MOORED PLATFORM DECK CASINGHEAD

[75] Inventor: James E. Lucksinger, Carbondale, Colo.

[73] Assignee: Standard Oil Company (Indiana), Chicago, Ill.

[21] Appl. No.: 943,402

[22] Filed: Sep. 18, 1978

[51] Int. Cl.[2] ..... E21B 19/10

[52] U.S. Cl. ..... 285/144; 285/330; 166/350; 166/367; 175/7; 405/227

[58] Field of Search ..... 405/195, 227; 285/140, 285/144, 330; 175/7; 166/367, 359, 330

[56] References Cited

U.S. PATENT DOCUMENTS

| | | | |
|---|---|---|---|
| 1,861,755 | 6/1932 | Rasmussen | 285/140 |
| 3,648,638 | 3/1972 | Blenkarn | 114/0.5 D |
| 3,976,021 | 8/1976 | Blenkarn et al. | 405/208 |
| 4,081,039 | 3/1978 | Wardlaw | 166/359 |
| 4,127,005 | 11/1978 | Osborne | 405/227 |

OTHER PUBLICATIONS

Composite Cat. Oil Field Equip. & Services, 27th Rev. 1966–67, pub. by World Oil, Houston, Tex., p. 1217.

*Primary Examiner*—Jacob Shapiro
*Attorney, Agent, or Firm*—John D. Gassett

[57] ABSTRACT

A novel casing torque hanger means for supporting the upper end of a string of casing from the upper end of a riser pipe which is supported by a floating vessel such as a Vertically Moored Platform. It includes a cylindrical member having a torque resistant spool below a casing hanger bowl. The casing string to be supported is provided with a casinghead mandrel at its upper end for engaging said torque resistant spool.

3 Claims, 5 Drawing Figures

VERTICALLY MOORED PLATFORM DECK CASINGHEAD

BRIEF DESCRIPTION OF INVENTION

This invention concerns an apparatus for connecting the upper end of casing extending from a subsea well to a floating vessel. It relates especially to connecting such casing to a tubular member such as a riser pipe which is supported in an upright position from the floating vessel. A novel casing torque hanger means is attached to the upper end of the riser pipe for supporting the casing string which is within the riser pipe. The casing torque hanger means can be described as a cylindrical torque resistant spool having at least a vertical slot on the interior thereof and a casing hanger bowl at the upper end of the spool. The upper end of the casing string is connected to a casinghead mandrel having a torque lug mating with the slot in the spool when the casing is inserted into said casing torque hanger means. Casing slips will be used between the casing hanger bowl and the upper end of the casinghead mandrel which is connected to the upper end of the casing to be supported within the riser. Torsion resistance is provided by the torque lugs of the casinghead mandrel and the torque lug slots of the torque resistant spool.

DETAILED DESCRIPTION

Figure 1:
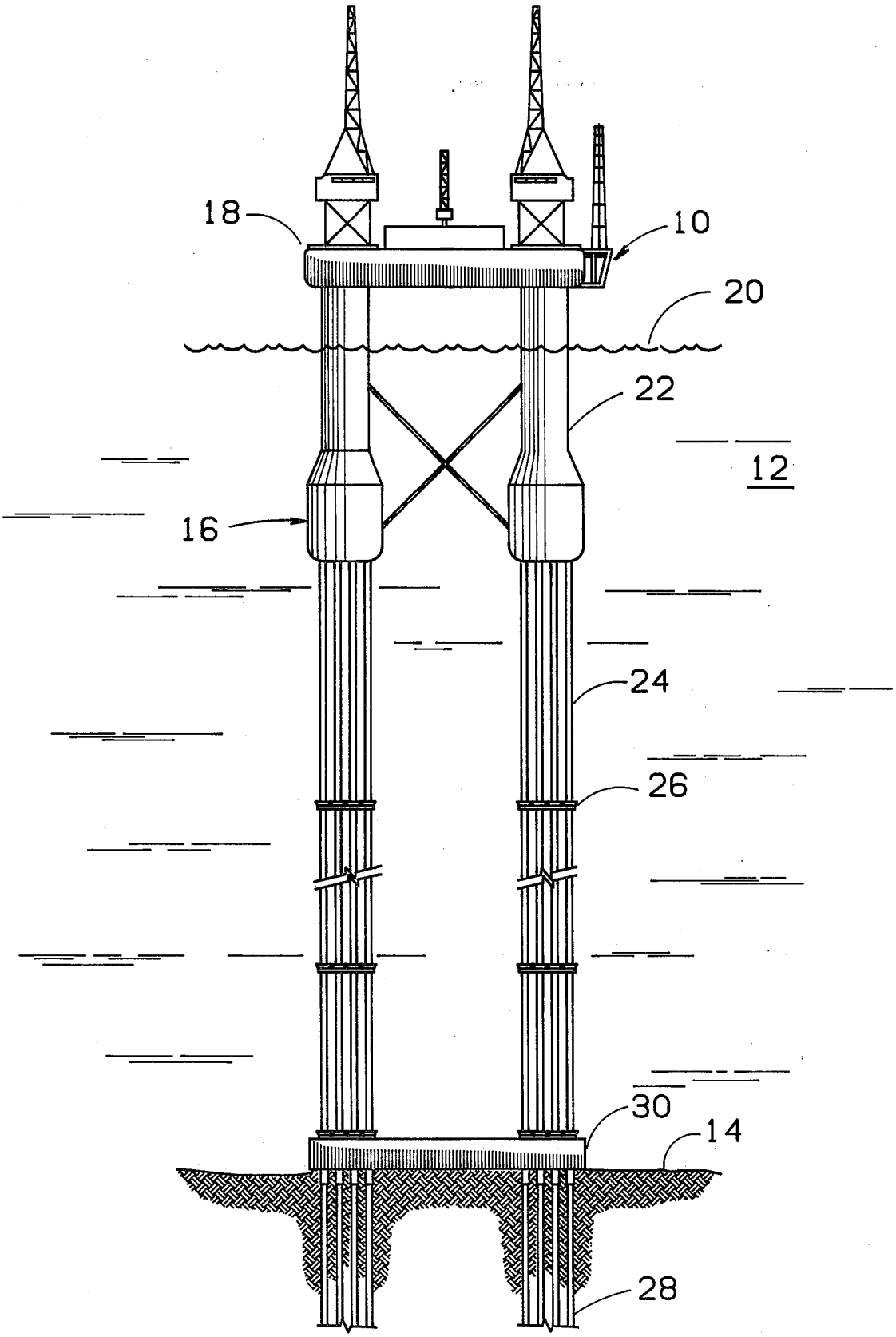
FIG. 1 is a schematic view of a Vertically Moored Platform.

Reference is first made to FIG. 1 which shows a side view of a Vertically Moored Platform (VMP). Shown therein is a platform 10 supported on a body of water 12 having a bottom 14. The structure 10 generally includes a float means 16 which supports a working deck 18 above the surface 20 of the body of water 12. It is to be noted that a VMP is described in detail in prior U.S. Pat. No. 3,648,638. Float means 16 is, for example, composed of four bottled shaped buoyant legs 22. Each leg 22 is anchored by a plurality of riser pipes 24 which are provided with spacers 26. Riser pipes 24 connect to casings 28 which are cemented in holes in the bottom of the body of water. A template 30 is shown on the bottom 14 through which the wells for casings 28 were guided. Riser pipes 24 normally are made of high quality steel and typically are 20 inches in diameter. The riser pipes 24 are parallel and are held in tension by the vertical force exerted on the buoyant structure. A typical length of these riser pipes 24 may be from 500 feet up to several thousand feet from the base of the leg members 22 of the VMP to the sea floor 14.

Within each riser pipe 24 in FIG. 1 there are a plurality of concentric strings of casing, not shown. Each such string is connected to the corresponding string cemented in the well 28. The upper end of each such concentric string is suspended from the upper end of the outer riser pipe 24. FIGS. 2 to 5 illustrate a novel casing hanger head assembly. One means of suspending or connecting the upper end of the riser pipe 24 to the Vertically Moored Platform is shown in FIGS. 17 and 18 of U.S. Pat. No. 3,976,021, issued Aug. 24, 1976, Kenneth A. Blenkarn and William D. Greenfield, inventors.

Figure 2:
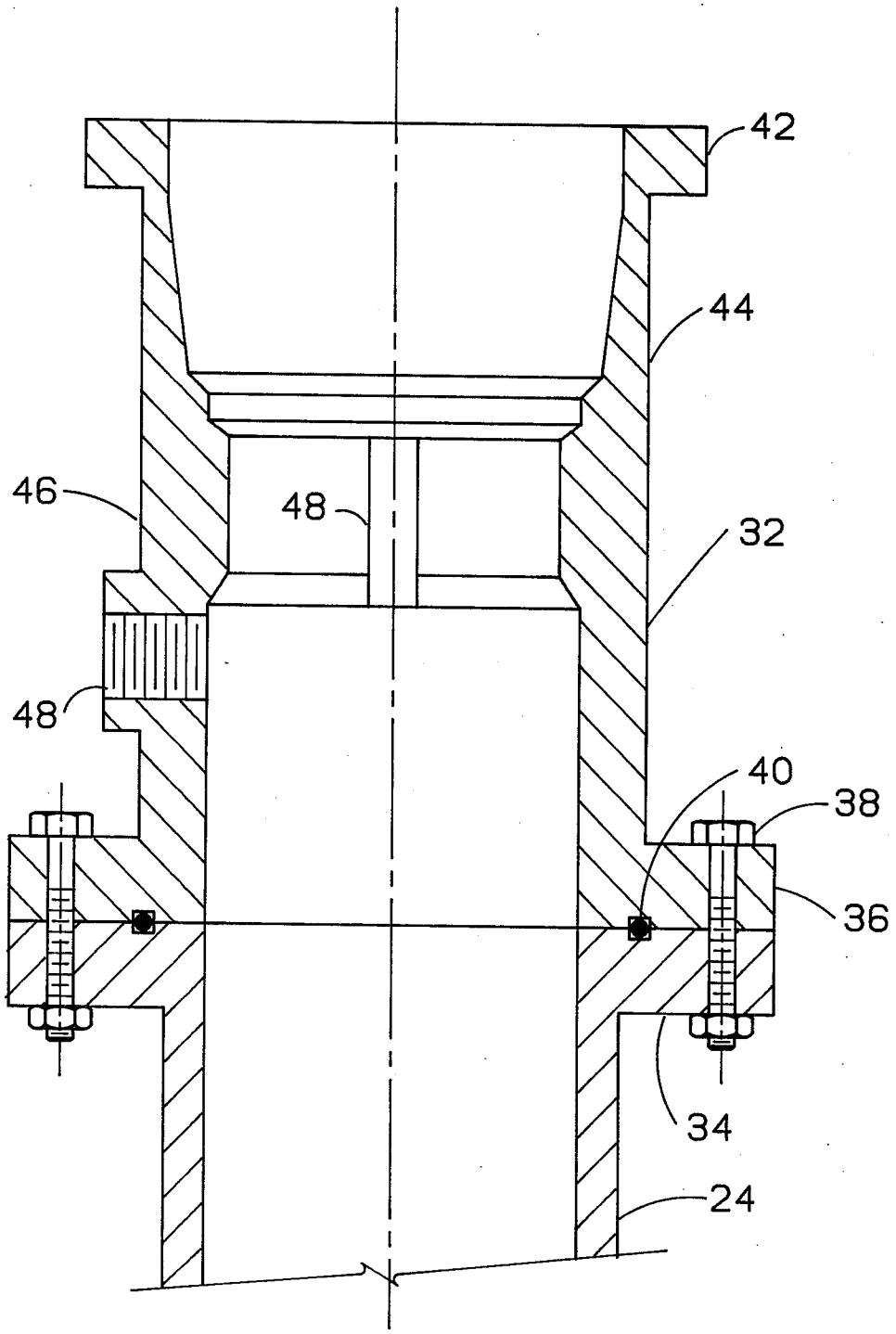
FIG. 2 illustrates, in section, a casing torque hanger head having a cylindrical torque resistant spool and having a vertical slot on the interior and a casing hanger bowl at the upper end.

Attention is next directed to FIG. 2 which shows a cylindrical casing torque hanger means 32 supported by the upper end of riser pipe 24. Riser pipe 24 is supported from the VMP or other floating vessel by support means described in U.S. Pat. No. 3,976,021 supra, at a point below shoulders 34. The casing torque hanger means 32 has lower shoulder 36 which is held by bolts 38 to shoulder 34 of the riser pipe 24. Seals 40 are provided to maintain a fluid-tight connection.

Casing torque hanger means 32 is provided with an upper shoulder 42 to which any desired wellhead equipment, or a smaller size casing hanger means, can be attached. Casing torque hanger means 32 is provided with a cylindrical torque resistant spool 46 having vertical slots 48 and a casing hanger bowl 44 as the upper portion of the casing torque hanger means. A port 48 is provided in the wall of the casing torque hanger means just below the cylindrical torque resistant spool 46.

Figure 3:
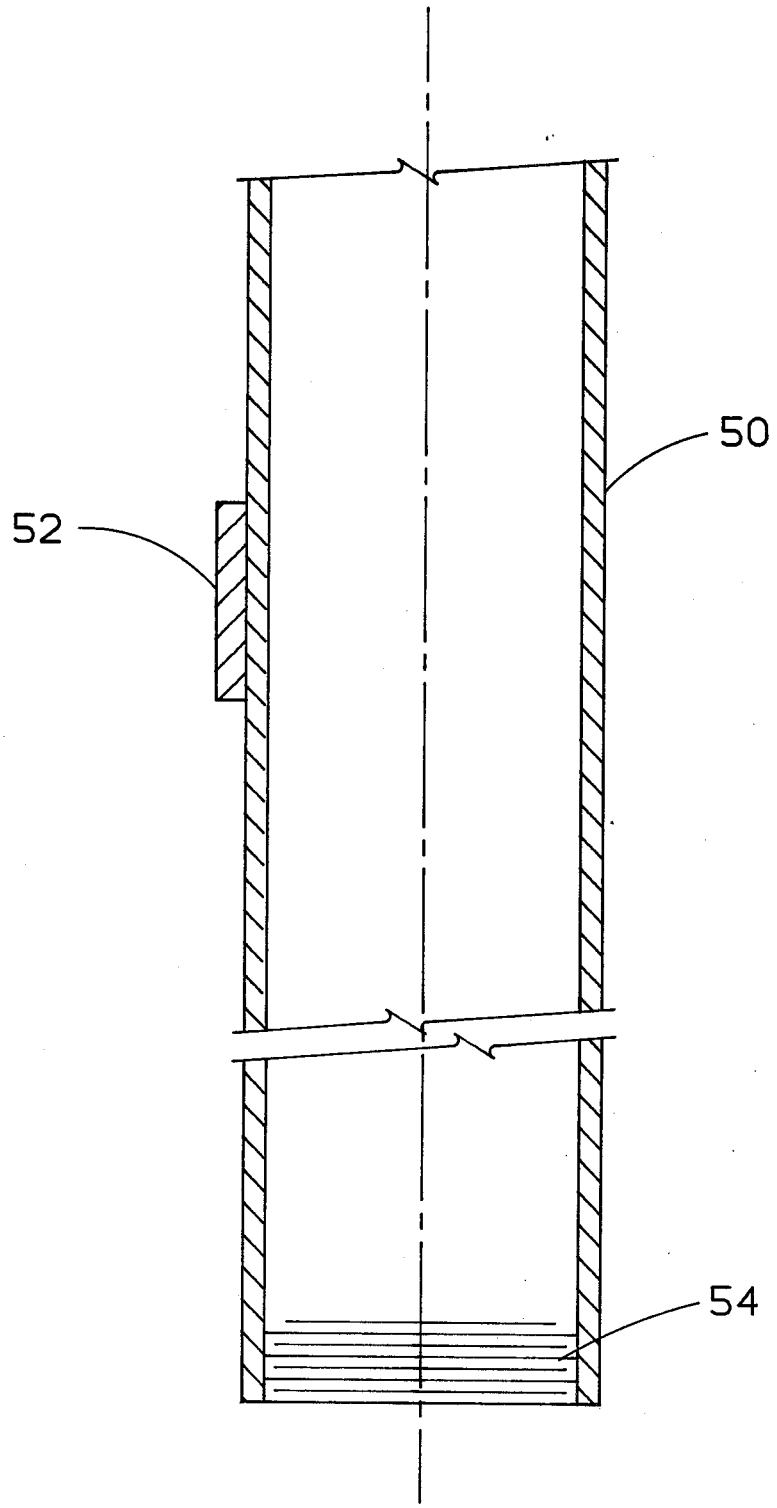
FIG. 3 illustrates a casinghead mandrel having a torque lug.
Figure 4:
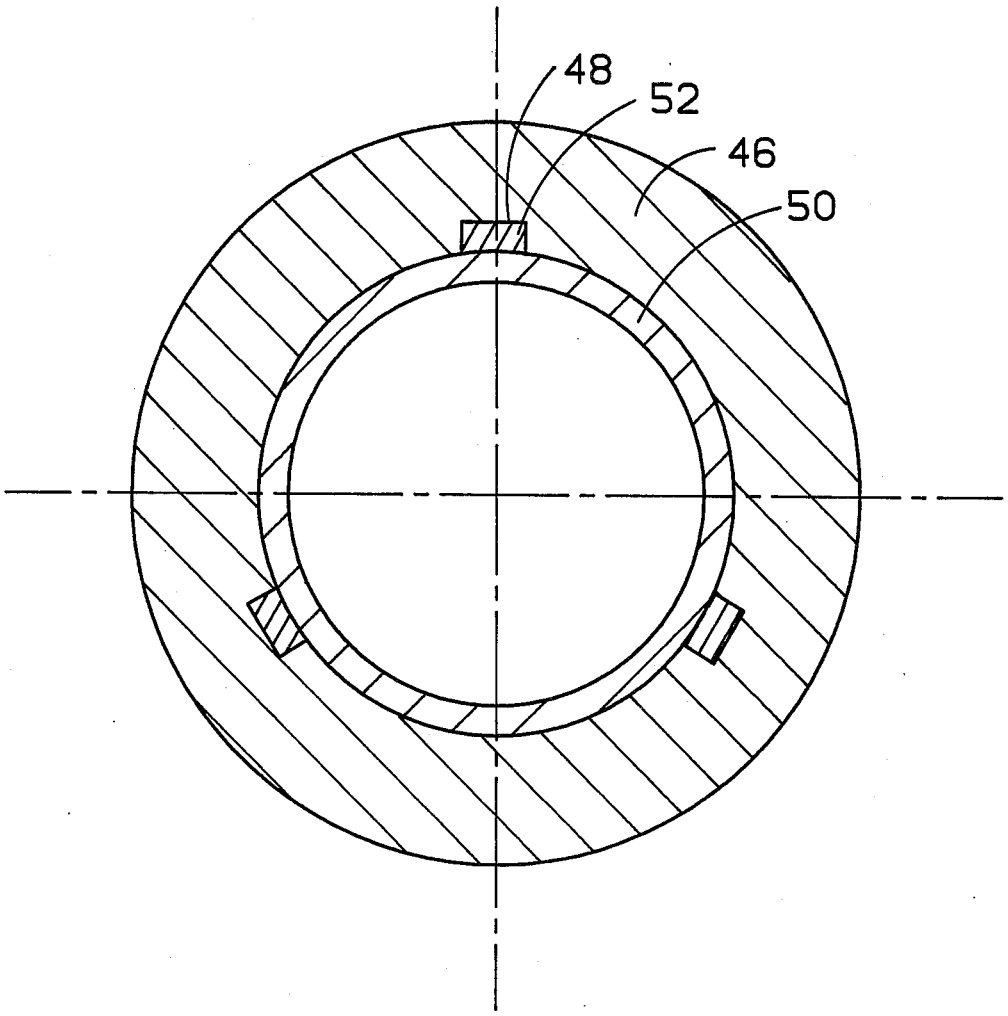
FIG. 4 is a view taken along the line 4—4 of FIG. 5.

Attention is next directed to FIG. 3 which illustrates a casinghead mandrel 50 having lug 52 which mates with the slot 48 of the casing torque hanger bowl 32 of FIG. 2. The casinghead mandrel 50 is provided with threads 54 for connection to a string of casing to be suspended within the riser pipe 24.

Figure 5:
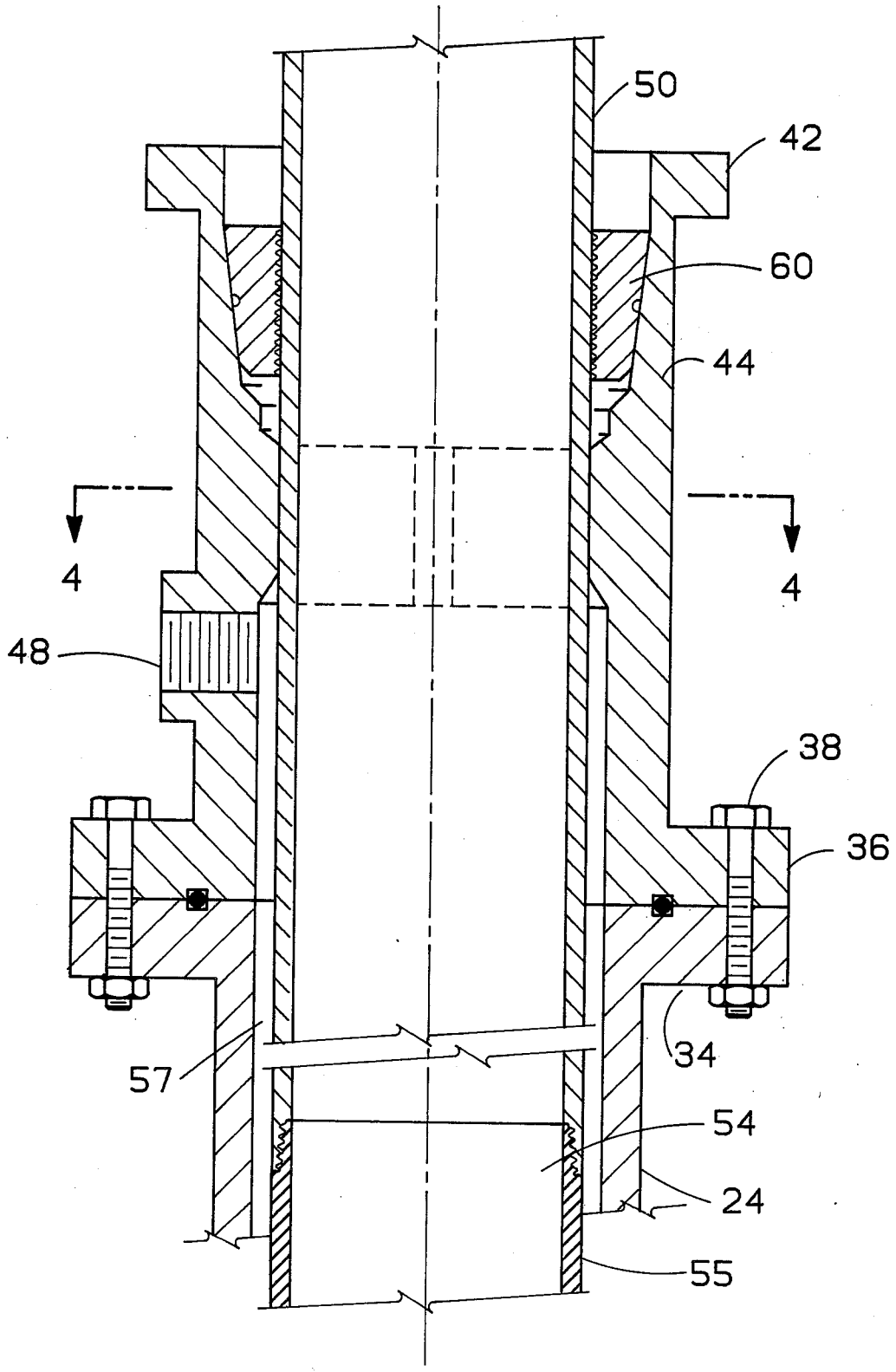
FIG. 5 illustrates the casinghead mandrel of FIG. 3 positioned in the casing hanger head shown in FIG. 2.

Attention is next directed to FIG. 5 which shows the casinghead mandrel of FIG. 3 inserted into the casing torque hanger means 32 of FIG. 2. Attention is also directed to FIG. 4 which is a view taken along the line 4—4 of FIG. 5. As can clearly be seen, the lug 52 of casinghead mandrel 50 is positioned in the slot 48 of torque resistant spool 46 of the casing torque hanger means. Thus there can be no rotational movement between the casing connected to casinghead mandrel 50 and the riser pipe 24. Conventional slips 60 are provided in the bowl 44 to hold casinghead mandrel 50. It is thus seen that the casing hanger means and casinghead mandrel will enable the casingheads to withstand the torsional forces imposed upon them by the dynamic motion of the VMP. Also the torque imposed upon the casing connected to casinghead mandrel 50 will not be transmitted to the casinghead packoff. The torque is received by the torque lugs 52 within the slots 48. The design and configuration of the casing hanger means and the casinghead mandrel permits the removal of casing 55, if desired. This can be accomplished by pulling the casing slips 60 and then lowering the lugs 52 to below the lug slots 48 to permit any turning of casing 55 if required for release from the mud line tie-back assembly. This is assuming that the casing string 55 is mechanically connected to its corresponding casing within casing 28 in a manner such that it can be released therefrom by rotation. Non-rotational means of releasably connecting the lower end of casing string 55 can be used. After the casing 55 is released at the lower end at the mud line, it can be pulled. It is also to be noted that the casinghead mandrel and casing torque hanger means permit circulation of fluid down the annulus 57 between riser 24 and casing 55 by insertion through port 48 which is ordinarily provided with either a plug or a valve. Also, with this arrangement standard packoffs between the casing string 55 or the casinghead mandrel 50 can be accomplished in the usual manner.

While the above description has been made in rather great detail, various modifications can be made thereto without departing from the spirit or scope of the invention.

What is claimed is:

1. An apparatus for connecting the upper end of a casing string extending from a subsea well to a floating vessel supporting an upright member which comprises:

a casing torque hanger means having a cylindrical torque resistant spool having at least a vertical slot on the interior thereof and a casing hanger bowl at the upper end of said spool;

means to support said casing hanger means from said upright member;

a casinghead mandrel having a lug mating with said slot when said mandrel is inserted into said casing hanger means and including means to connect said mandrel to said casing string.

2. An apparatus as defined in claim 1 including a port means in the wall of said casing torque hanger means.

3. An apparatus for supporting the upper end of a string of casing extending from a subsea well to a floating vessel and in which the vessel is anchored to the subsea well by at least a riser pipe which comprises:

a casing hanger means having:

(i) at least one vertical slot on the interior thereof;

(ii) a casing hanger bowl at the upper end of said casing hanger means;

means to support said hanger means from the upper end of said riser pipe;

a casinghead mandrel connectible to said string of casing and having a lug means at said slot when said mandrel is inserted into said casing hanger.

* * * * *